US010084273B2

(12) United States Patent
Netsu

(10) Patent No.: US 10,084,273 B2
(45) Date of Patent: Sep. 25, 2018

(54) ELECTRONIC APPARATUS

(71) Applicant: SEIKO EPSON CORPORATION, Tokyo (JP)

(72) Inventor: Takahiro Netsu, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/418,901

(22) Filed: Jan. 30, 2017

(65) Prior Publication Data

US 2017/0222378 A1 Aug. 3, 2017

(30) Foreign Application Priority Data

Feb. 2, 2016 (JP) ..... 2016-017722

(51) Int. Cl.

| | |
|---|---|
| ***H01R 27/00*** | (2006.01) |
| ***H01R 24/64*** | (2011.01) |
| ***H01R 13/66*** | (2006.01) |
| ***H01R 13/447*** | (2006.01) |
| ***H01R 13/703*** | (2006.01) |
| *H01R 107/00* | (2006.01) |

(52) U.S. Cl.

CPC ..... *H01R 27/00* (2013.01); *H01R 13/447* (2013.01); *H01R 13/665* (2013.01); *H01R 13/703* (2013.01); *H01R 24/64* (2013.01); *H01R 2107/00* (2013.01)

(58) Field of Classification Search

CPC ..... H01R 27/00
USPC ..... 439/218, 221
See application file for complete search history.

(56) References Cited

U.S. PATENT DOCUMENTS 2,288,241 A * 6/1942 Holcomb ..... H01R 13/44 439/133
2,445,927 A * 7/1948 Shaw ..... H01R 13/20 439/299
3,581,480 A * 6/1971 O'Connor, III ..... A01D 34/828 320/111
3,957,333 A * 5/1976 Kaminski ..... H01R 29/00 361/245
4,684,186 A * 8/1987 Hetherington ..... H01R 29/00 439/120
4,957,831 A * 9/1990 Meredith ..... H01H 9/0011 307/150
5,199,888 A * 4/1993 Condra ..... G06F 1/1616 312/292

(Continued)

OTHER PUBLICATIONS

E Repeaters; Universal Serial Bus 3.1 Specification, Revision 1.0 [retrieved from http://www.usb.org/developers/usbtypec—first accessed on Dec. 28, 2015].

(Continued)

*Primary Examiner* — Neil Abrams
(74) *Attorney, Agent, or Firm* — Workman Nydegger

(57) ABSTRACT

An electronic apparatus is configured to include a first connection port that is a connection port of a USB Type C; a second connection port that is a connection port of a USB other than the USB Type C; and a wire that branches off to the first connection port and the second connection port. The electronic apparatus has an exclusive structure in which, in a case where a connector is connected to one of the first connection port and the second connection port, another connector is not able to be connected to the other connection port.

7 Claims, 2 Drawing Sheets

(56) References Cited

U.S. PATENT DOCUMENTS 5,233,502 A * 8/1993 Beatty ..... G06F 1/162 248/558
5,243,275 A * 9/1993 Nakazawa ..... G01R 15/08 324/110
5,442,514 A * 8/1995 Hopkins ..... G11B 33/027 312/295
5,495,586 A * 2/1996 Adachi ..... G06F 1/1616 361/679.32
5,535,093 A * 7/1996 Noguchi ..... G06F 1/1632 361/679.43
5,545,046 A * 8/1996 Masuda ..... B60K 1/04 439/142
5,582,180 A * 12/1996 Manset ..... A61B 5/04286 439/135
5,701,232 A * 12/1997 Tang ..... G06F 1/1613 174/67
5,706,146 A * 1/1998 Ono ..... G11B 15/675 242/336
5,716,225 A * 2/1998 Stringer ..... H01R 29/00 439/221
5,755,821 A * 5/1998 Ngai ..... H01R 13/4532 439/138
5,793,352 A * 8/1998 Greenberg ..... G09G 5/006 345/699
5,801,922 A * 9/1998 Shen ..... G06F 1/1616 361/679.32
5,865,546 A * 2/1999 Ganthier ..... G06F 3/0202 341/22
6,139,342 A * 10/2000 Thompson ..... H01R 13/703 439/188
6,141,212 A * 10/2000 Fletcher ..... G06F 13/409 361/679.45
6,145,037 A * 11/2000 Sakakibara ..... G06K 7/0047 361/753
6,166,722 A * 12/2000 Kawabe ..... G06F 1/1616 345/163
6,736,681 B2 * 5/2004 Arnett ..... H05K 1/0228 439/676
6,765,485 B2 * 7/2004 Lee ..... H01R 13/641 340/531
6,893,267 B1 * 5/2005 Yueh ..... H01R 35/04 439/8
6,974,342 B2 * 12/2005 Thomas ..... H01R 13/64 439/222
7,086,879 B2 * 8/2006 Higham ..... H01R 31/06 439/137
7,104,837 B1 * 9/2006 Huang ..... H01R 35/02 439/540.1
7,466,555 B2 * 12/2008 Yamamoto ..... G06K 7/0043 361/728
7,540,748 B2 * 6/2009 Tracy ..... G06F 1/1616 439/131
7,561,420 B2 * 7/2009 Chueh ..... G06F 1/1616 361/679.55
7,632,139 B2 * 12/2009 Chou ..... G11B 33/122 439/541.5
7,815,450 B1 * 10/2010 Chen ..... H01R 27/00 439/172
7,857,659 B2 * 12/2010 Wang ..... G06F 1/16 439/501
7,874,857 B2 * 1/2011 Takei ..... H01R 27/00 439/218
7,946,866 B2 * 5/2011 Bernstein ..... A61B 5/14532 439/136
7,988,453 B2 * 8/2011 Loo ..... B60L 11/1818 439/142
8,021,176 B2 * 9/2011 Sekino ..... H01R 27/02 439/222
8,109,793 B2 * 2/2012 Faisandier ..... A61B 5/04325 439/630
8,162,691 B2 * 4/2012 Chang ..... H01R 13/514 439/541.5
8,348,687 B2 * 1/2013 Raines ..... H01R 27/00 439/170
8,417,292 B2 * 4/2013 Kim ..... H04M 1/72527 455/557
8,449,318 B2 * 5/2013 Beller ..... A61B 18/14 439/489
8,608,497 B2 * 12/2013 Bychkov ..... G06K 13/0806 439/218
8,734,171 B2 * 5/2014 Cameron ..... H01R 29/00 439/221
9,203,173 B2 * 12/2015 Wang ..... H01R 13/447
9,293,865 B2 * 3/2016 Schwandt ..... H01R 13/6476
9,901,388 B2 * 2/2018 Batchelor ..... A61B 18/14
9,979,114 B2 * 5/2018 Guo ..... H01R 13/40
9,991,656 B1 * 6/2018 Tsai
2008/0182442 A1 * 7/2008 Choi ..... H01R 13/642 439/166
2009/0190142 A1 * 7/2009 Taylor ..... G06F 1/1632 358/1.1
2017/0222378 A1 * 8/2017 Netsu ..... H01R 24/64
2017/0222379 A1 * 8/2017 Leigh ..... H01R 27/00

OTHER PUBLICATIONS

USB 3.1 Specification—Welcome Message; Oct. 1, 2014.
USB 3.0 Adopters Agreement [retrieved from http://www.usb.org/developers/usbtypec—first accessed on Dec. 28, 2015].
Universal Serial Bus 3.1 Specification Hewlett-Packard Company, Intel Corporation, Microsoft Corporation, Renesas Corporation, ST-Ericsson, Texas Instruments; Revision 1.0 Jul. 26, 2013.
On-The-Go and Embedded Host Supplement to the USB Revision 3.0 Specification; Revision 1.1; May 10, 2012.
Inter-Chip Supplement to the USB Revision 3.0 Specification; Revision 1.02; May 19, 2014.
USB 3.1 Engineering Change Notice; Title: USB 3.1 CTLE; Applied to: USB_3_1r1.0_07_31_2013; Jul. 31, 2013.
USB 3.1 Engineering Change Notice; Title: HSEQ; Applied to: USB_3_1r1.0_07_31_2013; Jul. 31, 2013.
USB 3.1 Engineering Change Notice; Title: USB 3.1 wHubDelay; Applied to: USB_3_1r1.0_07_31_2013; Jul. 31, 2013.
USB 3.1 Engineering Change Notice; Title: USB 3.1 LTM; Applied to: USB_3_1r1.0_07_31_2013; Jul. 31, 2013.
USB 3.1 Engineering Change Notice; Title: Polling LFPS; Applied to: USB_3_1r1.0_07_31_2013; Jul. 31, 2013.
USB 3.1 Engineering Change Notice; Title: USB 3.1 PTM Value; Applied to: USB_3_1r1.0_07_31_2013; Jul. 31, 2013.
USB 3.1 Engineering Change Notice; Title: SKP OS Bytes During Compliance Clarification; Applied to: USB_3_1r1.0_07_31_2013; Jul. 31, 2013.
USB 3.1 Engineering Change Notice; Title: USB3.1 SKP Ordered Set Definition; Applied to: USB_3_1r1.0_07_31_2013; Jul. 31, 2013.
USB 3.1 Engineering Change Notice; Title: SLC IS SDS; Applied to: USB_3_1r1.0_07_31_2013; Jul. 31, 2013.
USB 3.1 Engineering Change Notice; Title: SSP ping.LFPS tRepeat Requirement; Applied to: USB_3_1r1.0_07_31_2013; Jul. 31, 2013.
USB 3.1 Engineering Change Notice; Title: SSP System Jitter Budget; Applied to: USB_3_1r1.0_07_31_2013; Jul. 31, 2013.
USB 3.1 Engineering Change Notice; Title: USB3.1 tHubDriveResume; Applied to: USB_3_1r1.0_07_31_2013; Jul. 31, 2013.
USB 3.1 Engineering Change Notice; Title: TSEQ Gen2 Clarification; Applied to: USB_3_1r1.0_07_31_2013; Jul. 31, 2013.
USB 3.1 Engineering Change Notice; Title: Vbus 5V Nominal Range; Applied to: USB Specification Version 3.1; Jul. 31, 2013.
USB 3.1 Engineering Change Notice; Title: USB 3.1 VBUS Max Limit; Applied to: USB_3_1r1.0_07_31_2013; Jul. 31, 2013.
USB 3.1 Engineering Change Notice; Title: TSEQ SKP Insertion Interval; Applied to: USB 3.1 Specification Release [retrieved from http://www.usb.org/developers/usbtypec—first accessed on Dec. 28, 2015].
USB 3.1 Engineering Change Notice Form; Title: Loopback BERT; Applied to: USB 3.1 Specification Release [retrieved from http://www.usb.org/developers/usbtypec—first accessed on Dec. 28, 2015].

(56) References Cited

OTHER PUBLICATIONS

USB 3.1 Engineering Change Notice Form; Title: Reference Clock Reqs; Applied to: USB 3.1 Specification Release [retrieved from http://www.usb.org/developers/usbtypec—first accessed on Dec. 28, 2015].
USB 3.1 Engineering Change Notice Form; Title: Loss Budget Clarification; Applied to: USB 3.1 Specification Release [retrieved from http://www.usb.org/developers/usbtypec—first accessed on Dec. 28, 2015].
USB 3.1 Engineering Change Notice Form; Title: Rx JTOL RJ Correction; Applied to: USB 3.1 Specification Release [retrieved from http://www.usb.org/developers/usbtypec—first accessed on Dec. 28, 2015].
USB 3.0 Engineering Change Notice Form; Title: USB3.1 U3/U2 TX Common Mode Specification; Applied to: USB3.1 [retrieved from http://www.usb.org/developers/usbtypec—first accessed on Dec. 28, 2015].
USB 3.1 Engineering Change Notice Form; Title: USB3.1 SCD Clarifications; Applied to: USB3.1 [retrieved from http://www.usb.org/developers/usbtypec—first accessed on Dec. 28, 2015].
USB 3.1 Engineering Change Notice Form; Title: TSEQ Clarifications; Applied to: USB3.1 [retrieved from http://www.usb.org/developers/usbtypec—first accessed on Dec. 28, 2015].
USB 3.1 Engineering Change Notice Form; Title: Retimer PTM; Applied to: USB3.1 [retrieved from http://www.usb.org/developers/usbtypec—first accessed on Dec. 28, 2015].
USB 3.1 Engineering Change Notice Form; Title: Rx High Z measurement; Applied to: USB3.1 [retrieved from http://www.usb.org/developers/usbtypec—first accessed on Dec. 28, 2015].
USB 3.1 Engineering Change Notice Form; Title: Rx High Z Value; Applied to: USB3.1 [retrieved from http://www.usb.org/developers/usbtypec—first accessed on Dec. 28, 2015].
USB 3.1 Engineering Change Notice Form; Title: Gen 1 AC Coupling; Applied to: USB3.1 [retrieved from http://www.usb.org/developers/usbtypec—first accessed on Dec. 28, 2015].
USB 3.1 Engineering Change Notice Form; Title: Tx RJ Measurement Point; Applied to: USB3.1 [retrieved from http://www.usb.org/developers/usbtypec—first accessed on Dec. 28, 2015].
USB 3.1 Engineering Change Notice Form; Title: LFPS Typos; Applied to: USB3.1 [retrieved from http://www.usb.org/developers/usbtypec—first accessed on Dec. 28, 2015].
Universal Serial Bus Type-C Authentication Specification; [retrieved from http://www.usb.org/developers/usbtypec—first accessed on Dec. 28, 2015]; Revision 1.0 Mar. 25, 2016.
USB 3.1 Device Class Specification for Debug Devices; Revision 1.0—Jul. 14, 2015.
Universal Serial Bus; Type-CTM Port Controller Interface Specification; [retrieved from http://www.usb.org/developers/usbtypec—first accessed on Dec. 28, 2015]; Revision 1.0, Version 1.1 Jul. 2016.
"USB Power Delivery Specification" Adopters Agreement; letter dated Jul. 9, 2012.
Universal Serial Bus Power Delivery Specification; [retrieved from http://www.usb.org/developers/usbtypec—first accessed on Dec. 28, 2015]; Revision 2.0, V1.2. Mar. 25, 2016 + ECNs Aug. 2, 2016.
USB Power Delivery Engineering Change Notice; Title: Applicability of Messages; Applied to: USB Power Delivery Specification Revision 2.0 V1.2 [retrieved from http://www.usb.org/developers/usbtypec—first accessed on Dec. 28, 2015].
USB Power Delivery Engineering Change Notice; Title: Remove PD and USB bcdDevice association; Applied to: USB Power Delivery Specification Revision 2.0 Version 1.2 [retrieved from http://www.usb.org/developers/usbtypec—first accessed on Dec. 28, 2015].
USB Power Delivery Engineering Change Notice; Title: DRP and DRD bits in SrcCap and SnkCap messages; Applied to: USB Power Delivery Specification Revision 2.0 Version 1.2 [retrieved from http://www.usb.org/developers/usbtypec—first accessed on Dec. 28, 2015].
USB Power Delivery Engineering Change Notice; Title: iCapChange Removal; Applied to: USB Power Delivery Specification Revision 2.0 Version 1.2 [retrieved from http://www.usb.org/developers/usbtypec—first accessed on Dec. 28, 2015].
USB Power Delivery Engineering Change Notice; Title: Sink No Response Timer; Applied to: USB Power Delivery Specification Revision 2.0 Version 1.2 [retrieved from http://www.usb.org/developers/usbtypec—first accessed on Dec. 28, 2015].
USB Power Delivery Engineering Change Notice; Title: Source State Diagram; Applied to: USB Power Delivery Specification Revision 2.0 Version 1.2 [retrieved from http://www.usb.org/developers/usbtypec—first accessed on Dec. 28, 2015].
USB Power Delivery Engineering Change Notice; Title: Language Relating to VDM Commands; Applied to: USB Power Delivery Specification Revision 2.0 V1.2 [retrieved from http://www.usb.org/developers/usbtypec—first accessed on Dec. 28, 2015].
USB Power Delivery Engineering Change Notice; Title: vSafe5V Voltage Range Clarification; Applied to: USB Power Delivery Specification Revision 2.0 Version 1.2 [retrieved from http://www.usb.org/developers/usbtypec—first accessed on Dec. 28, 2015].
USB Power Delivery Engineering Change Notice; Title: USB PD Wait Timing; Applied to: USB Power Delivery Specification Revision 2.0 Version 1.2 [retrieved from http://www.usb.org/developers/usbtypec—first accessed on Dec. 28, 2015].
USB Power Delivery Engineering Change Notice Form; Title: PD2.0 Externally Powered becomes Unconstrained Power; Applied to: USB Power Delivery Specification Revision 2.0 Version 1.2 [retrieved from http://www.usb.org/developers/usbtypec—first accessed on Dec. 28, 2015].
USB Power Delivery Engineering Change Notice Form; Title: PD2.0 Unexpected message received in PE Ready state; Applied to: USB Power Delivery Specification Revision 2.0 Version 1.2 [retrieved from http://www.usb.org/developers/usbtypec—first accessed on Dec. 28, 2015].
Universal Serial Bus Type-C Locking Connector Specification; [retrieved from http://www.usb.org/developers/usbtypec—first accessed on Dec. 28, 2015]; Revision 1.0 Mar. 9, 2016.
Universal Serial Bus Type-C Cable and Connector Specification; [retrieved from http://www.usb.org/developers/usbtypec—first accessed on Dec. 28, 2015]; Revision 1.2; Mar. 25, 2016.
USB Type-C Engineering Change Notice Form; Title: Audio Adapter State Change; Applied to: USB Type-C Specification Release 1.2 [retrieved from http://www.usb.org/developers/usbtypec—first accessed on Dec. 28, 2015].
USB Type-C Engineering Change Notice Form; Title: Debug Accessory Appendix Applied to: USB Type-C Specification Release 1.2 [retrieved from http://www.usb.org/developers/usbtypec—first accessed on Dec. 28, 2015].
USB Type-C Engineering Change Notice; Title: Correction for Attached.SNK Applied to: USB Type-C Specification Release 1.2 Draft, Dec. 2015.
USB Type-C Engineering Change Notice; Title: Debug Accessory Appendix; [retrieved from http://www.usb.org/developers/usbtypec—first accessed on Dec. 28, 2015]; Applied to: USB Type-C Specification Release 1.2, Mar. 25, 2016.
USB Type-C Engineering Change Notice; Title: Change plug overmold length from MAX to REF; Applied to: USB Type-C Specification Release 1.2 [retrieved from http://www.usb.org/developers/usbtypec—first accessed on Dec. 28, 2015].
USB Type-C Engineering Change Notice; Title: Removal of Proprietary Charging Methods; [retrieved from http://www.usb.org/developers/usbtypec—first accessed on Dec. 28, 2015]; Applied to: USB Type-C Specification Release 1.2, Mar. 25, 2016.
USB Type-C Engineering Change Notice; Title: Source VCONN Discharge Applied to: USB Type-C Specification Release 1.2 [retrieved from http://www.usb.org/developers/usbtypec—first accessed on Dec. 28, 2015].
USB Type-C Engineering Change Notice; Title: USB Type-C ECR on the SRC-to-TrySRC looping; Applied to: USB Type-C Specification Release 1.1, Apr. 3, 2015.
USB Type-C Engineering Change Notice; Title: USB 2.0 Type-C receptacle; [retrieved from http://www.usb.org/developers/usbtypec—first accessed on Dec. 28, 2015]; Applied to: USB Type-C Specification Release 1.2, Draft, Mar. 9, 2016.

(56) References Cited

OTHER PUBLICATIONS

USB Type-C Engineering Change Notice; Title: D+/D− DC Resistance Applied to: USB Type-C Specification Release 1.2 [retrieved from http://www.usb.org/developers/usbtypec—first accessed on Dec. 28, 2015].
USB Type-C Engineering Change Notice Form; Title: VBUS Coupling Applied to: USB Type-C Specification Release 1.2 [retrieved from http://www.usb.org/developers/usbtypec—first accessed on Dec. 28, 2015].
USB Type-C Engineering Change Notice; Title: USB Type-C ECR VCONN Requirements; [retrieved from http://www.usb.org/developers/usbtypec—first accessed on Dec. 28, 2015]; Applied to: USB Type-C Specification Release 1.2, Mar. 25, 2016.
USB Type-C Engineering Change Notice Form; Title: Multi-port Chargers Applied to: USB Type-C Specification Release 1.2 [retrieved from http://www.usb.org/developers/usbtypec—first accessed on Dec. 28, 2015].
USB Type-C Engineering Change Notice; Title: Try.SNK and Try.SRC usage recommendations Applied to: USB Type-C Specification Release 1.2 [retrieved from http://www.usb.org/developers/usbtypec—first accessed on Dec. 28, 2015].
USB Type-C Engineering Change Notice Form; Title: USB 2.0 Hubs with Type-C Connectors; Applied to: USB Type-C Specification Release 1.2 [retrieved from http://www.usb.org/developers/usbtypec—first accessed on Dec. 28, 2015].
USB Type-C Engineering Change Notice Form; Title: Vconn for Power Adapters Applied to: USB Type-C Specification Release 1.2 [retrieved from http://www.usb.org/developers/usbtypec—first accessed on Dec. 28, 2015].
http://www.usb.org/developers/usbtypec accessed on Dec. 28, 2015.

* cited by examiner

ELECTRONIC APPARATUS

CROSS-REFERENCE TO RELATED APPLICATIONS

The entire disclosure of Japanese Patent Application No.: 2016-017722, filed Feb. 2, 2016 is incorporated by reference herein.

BACKGROUND

1. Technical Field

The present invention relates to an electronic apparatus.

2. Related Art

In the related art, a universal serial bus (USB) standard defines various types. Recently, a standard which is called the USB Type C (refer to USB Type-C Cable and Connector Specification [searched on Dec. 28, 2015], Internet<URL: http://www.usb.org/developers/usbtypec/>) is defined and is begun to spread.

SUMMARY

In a case where an electronic apparatus corresponding to a plurality of USB standards is configured, an electronic apparatus having a plurality of sets of circuits corresponding to each standard is configured in the related art. An advantage of some aspects of the invention is to provide a technology of simplifying a configuration of a circuit.

According to one aspect of the invention, an electronic apparatus is configured to include a first connection port that is a connection port of a USB Type C; a second connection port that is a connection port of a USB other than the USB Type C; and a wire that branches off to the first connection port and the second connection port. The electronic apparatus has an exclusive structure in which, in a case where a connector is connected to one of the first connection port and the second connection port, another connector is not able to be connected to the other connection port.

That is, the electronic apparatus according to an embodiment of the invention includes a wire which is connected to an internal circuit of the electronic apparatus, branches off, and is connected to the first connection port and the second connection port, and can connect a connector to any one of the first connection port and the second connection port by using an exclusive structure. Hence, the electronic apparatus needs not individually include circuits corresponding to each of the USB of the USB Type C and the USB other than the USB Type C so as to perform communication by the USB, and may include a common circuit for processing the USB of the USB Type C and the USB other than the USB Type C. For this reasons, it is possible to simplify a configuration of the circuits of the electronic apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Here, embodiments of the invention will be described according to the following order.

Figure 1A:
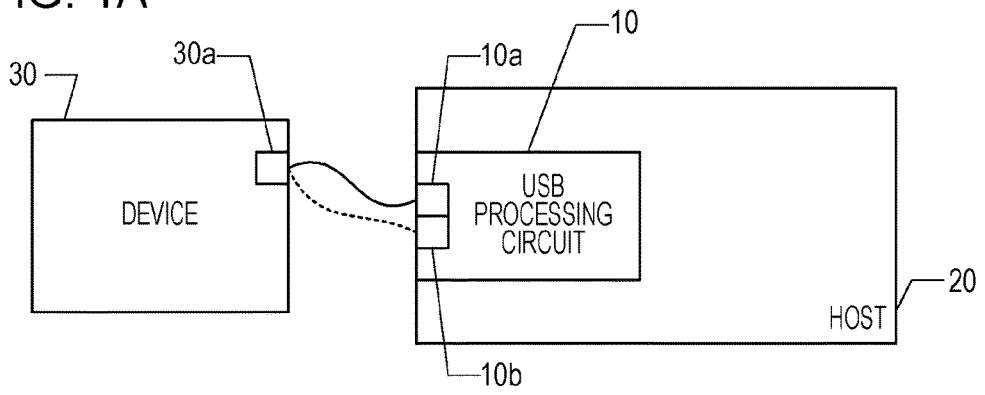
FIG. 1A is an explanatory diagram illustrating a usage aspect of an electronic apparatus according to an embodiment of the invention.

1. Usage Aspect of Electronic Apparatus
1-1. Configuration of Exclusive Structure
1-2. Configuration of USB Processing Circuit
2. Another Embodiment 1. Usage Aspect of Electronic Apparatus FIG. 1A is an explanatory diagram illustrating a usage aspect of an electronic apparatus according to an embodiment of the invention. The electronic apparatus according to the present embodiment functions as a host. That is, a host 20 which becomes a power supply side according to a standard of the USB is an embodiment of the invention, and the host 20 is connected to a device 30 which receives power by the USB. The host 20 includes a USB processing circuit 10.

The USB processing circuit 10 processes a signal and power according to the USB, and includes a first connection port 10*a* and a second connection port 10*b*. The first connection port 10*a* can be connected to a connector of the USB Type C, and the second connection port 10*b* can be connected to a connector of USB Type A. The first connection port 10*a* and the second connection port 10*b* are open at an outer surface of the host 20, and a connector can be connected to the opening.

The device 30 is an electronic apparatus which is connected to the host 20, and includes a connection port 30*a* to which a connector according to a standard of either the USB Type C or the USB Type A can be connected. In a case where the connection port 30*a* of the device 30 can be connected to a connector of the USB Type C, the connection port 30*a* of the device 30 and the first connection port 10*a* of the host 20 are connected to a cable of the USB Type C. In FIG. 1A, the cable is denoted by a solid line. In a case where the connection port 30*a* of the device 30 can be connected to a connector of the USB Type A, the connection port 30*a* of the device 30 and the second connection port 10*b* of the host 20 are connected to a cable of the USB Type A. In FIG. 1A, the cable is denoted by a dashed line.

As such, according to the present embodiment, even in a case where the device 30 corresponds to a standard of either the USB Type A or the USB Type C, the device can be connected to the host 20. If the device 30 is connected to the host 20, the host 20 supplies power to the device 30 through the USB cable, according to the necessity, and communication is performed between the host 20 and the device 30.

1-1. Configuration of Exclusive Structure

Figure 1B:
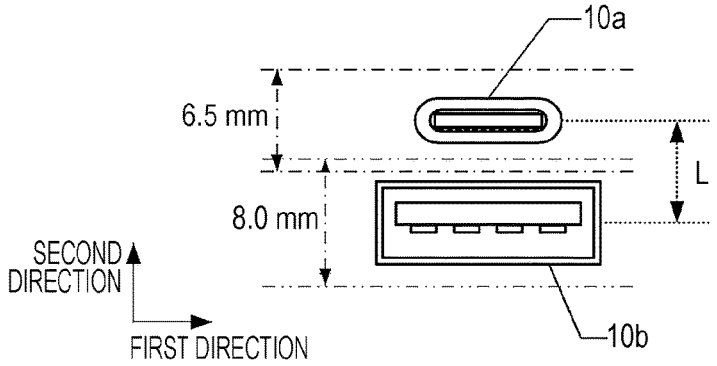
FIG. 1B is an explanatory view of an exclusive structure.

FIG. 1B is a view illustrating a state where the first connection port 10*a* and the second connection port 10*b* which are open at the outer surface of the host 20 are viewed from the opening side. In FIG. 1B, a first direction is orthogonal to a second direction, and in the present embodiment, the second direction is a vertical direction of the host 20, but, of course, the second direction may be a horizontal direction or may be other directions.

In the present embodiment, in a case where connectors are connected to each of the connection port, the first connection port 10*a* and the second connection port 10*b* are formed on the outer surface of the host 20 such that the connectors are in a positional relationship of spatially overlapping each other. That is, in the present embodiment, the first connection port 10*a* and the second connection port 10*b* are in a specified positional relationship with each other, and thereby, an exclusive structure is formed in which the connector can be connected to only one of the first connection port 10*a* and the second connection port 10*b*.

Specifically, each of the first connection port 10*a* and the second connection port 10*b* has a long opening at one side thereof. Here, in the opening, a side parallel with the one side is referred to as a long side, and a direction parallel with the long side is referred to as a short side direction. In the embodiment, the long side of each of the first connection port 10*a* and the second connection port 10*b* faces the first direction, and the first connection port 10*a* and the second connection port 10*b* are at the same position in the first direction. That is, the first connection port 10*a* overlaps the second connection port 10*b* in the first direction.

Furthermore, a short side of each of the first connection port 10*a* and the second connection port 10*b* faces the second direction, and a distance L between the center of the short side direction of the first connection port 10*a* and the center of the short side direction of the second connection port 10*b* is set to a value by which, if a connector is connected to one connection port, the connector cannot be connected to the other connection port. That is, the distance L is set to a distance in which, if a connector of the USB Type A is connected to the second connection port 10*b* in a state where a connector of the USB Type C is connected to the first connection port 10*a*, the both connectors interfere with each other and thereby the connector cannot be connected to the second connection port 10*b*. A maximum value of the connector of the USB Type C in the short side direction is 6.5 mm, and a maximum value of the connector of the USB Type A in the short side direction is 8.0 mm, and thus, the distance L is less than 7.25 (=(8.0+6.5)/2) mm.

According to the aforementioned configuration, in a case where, in a state where a connector is connected to one of the first connection port 10*a* and the second connection port 10*b*, another connector is connected to the other of the connection ports, the former connector interferes with the latter connector such that the latter connector cannot be inserted into the connection port. Hence, either a connector of the USB Type A or a connector of the USB Type C can be inserted into the host 20.

1-2. Configuration of USB Processing Circuit

Figure 1C:
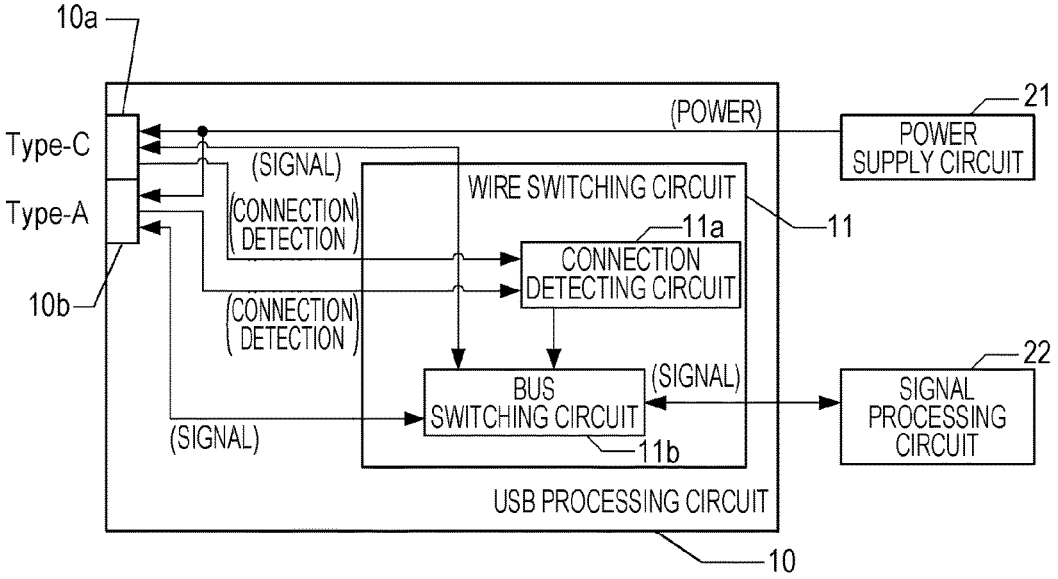
FIG. 1C is a diagram illustrating a configuration of a control circuit included in the electronic apparatus.

FIG. 1C is a diagram illustrating a configuration of the USB processing circuit 10 included in the host 20 which can perform communication corresponding to the SuperSpeed standard. The USB processing circuit 10 includes a wire switching circuit 11 and wires extending from the first connection port 10*a* and the second connection port 10*b*. The wire switching circuit 11 includes a connection detecting circuit 11*a* and a BUS switching circuit 11*b*.

The connection detecting circuit 11*a* is connected to each of the first connection port 10*a* and the second connection port 10*b* by signal lines. The connection detecting circuit 11*a* can detect whether or not connectors are connected to the first connection port 10*a* and the second connection port 10*b*. In addition, the connection detecting circuit 11*a* is connected to the BUS switching circuit 11*b* by a signal line, and, in a case where the connection detecting circuit detects that a connector is connected to any one of the first connection port 10*a* and the second connection port 10*b*, the connection detecting circuit 11*a* outputs information indicating the detected connection port to the BUS switching circuit 11*b*.

The BUS switching circuit 11*b* is connected to each of the first connection port 10*a* and the second connection port 10*b*, and a signal processing circuit 22 included in the host 20 by signal lines. The BUS switching circuit 11*b* includes a switch which switches a connection between a signal line extending from the signal processing circuit 22 and any one of signal lines extending from the first connection port 10*a* and the second connection port 10*b*, and controls the switch on the basis of an output signal of the connection detecting circuit 11*a*.

That is, in a case where the output signal of the connection detecting circuit 11*a* indicates that a connector is connected to the first connection port 10*a*, the BUS switching circuit 11*b* controls the switch such that the first connection port 10*a* is connected to the signal processing circuit 22. In addition, in a case where the output signal of the connection detecting circuit 11*a* indicates that a connector is connected to the second connection port 10*b*, the BUS switching circuit 11*b* controls the switch such that the second connection port 10*b* is connected to the signal processing circuit 22. The connection detecting circuit 11*a* may be configured to become one piece with the wire switching circuit 11, or may be configured as a separated unit.

The signal processing circuit 22 performs communication based on the standards of the USB Type C and the USB Type A. In a case where the device 30 is connected to the first connection port 10*a* or the second connection port 10*b* through a cable, communication can be performed between a connection port connected to a connector and the signal processing circuit 22 by controlling the switch of the BUS switching circuit 11*b*.

Meanwhile, the host 20 includes a power supply circuit 21. The power supply circuit 21 generates power of a voltage defined in the USB standard. The power supply circuit 21 includes a power line extending toward the USB processing circuit 10, and the power line branches off and is connected to the first connection port 10*a* and the second connection port 10*b*. Hence, power that is generated by the power supply circuit 21 is supplied to the device 30 through a connector connected to the first connection port 10*a* or the second connection port 10*b*.

According to the aforementioned configuration, the device 30 can be driven by receiving power from the host 20, and USB communication can be performed by the host 20 and the device 30. In the present embodiment in which wires are switched by the wire switching circuit 11, one of the first connection port 10*a* and the second connection port 10*b* is connected to a communication line connected to the signal processing circuit 22, the other is not connected to the communication line. For this reason, leakage or the like of a signal from a communication line through which communication is performed to a communication line through which communication is not performed is reduced. Hence, it is possible to transmit a signal whose frequency is high and frequency loss cannot be neglected, for example, a signal according to the SuperSpeed standard.

Furthermore, in the present embodiment, an exclusive structure is formed in the host 20, and thus, a connector can be connected to any one of the first connection port 10*a* and the second connection port 10*b*. Hence, the host 20 performs communication according to the USB standard, and thus, the host does not need to individually include a circuit for corresponding to each of the USB Type C and USB Type A, and the power supply circuit 21 and the signal processing circuit 22 which are common in each standard may be included. For this reason, it is possible to simplify a configuration of a circuit of an electronic apparatus.

2. Another Embodiment

The aforementioned embodiment is an example for realizing the invention, and, as long as a configuration is provided in which, if a connector is connected to one of connection ports of the USB of different standards, a connector cannot be connected to other connection ports, various other embodiments can be employed. For example, an electronic apparatus according to the invention may function as a host according to the USB standard, or may function as a device.

Figure 2A:
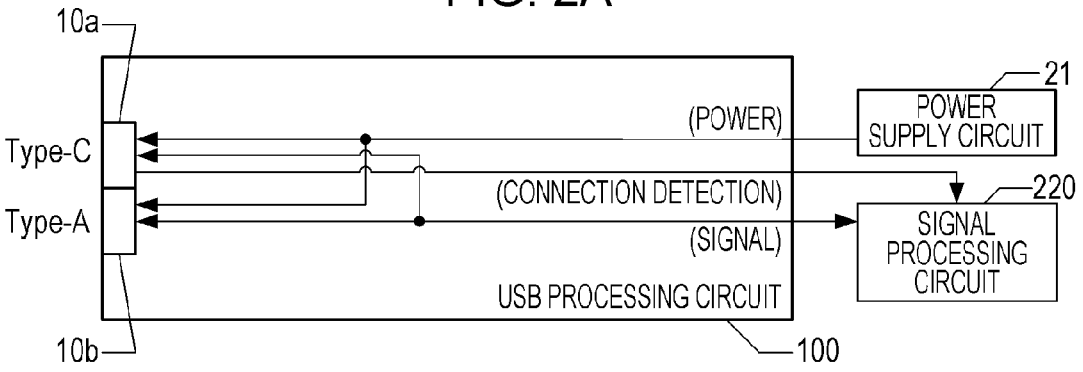
FIG. 2A is a diagram illustrating a configuration of a control circuit included in an electronic apparatus.

In addition, in the aforementioned embodiment, the USB processing circuit 10 includes the wire switching circuit 11, but, if a signal in which influence of high frequency loss due to branching of a signal that is transmitted cannot be neglected, for example, a signal of the High Speed standard is used, the wire switching circuit 11 can be omitted. FIG. 2A illustrates a configuration of a USB processing circuit 100 configured by omitting the wire switching circuit 11 from the USB processing circuit 10 illustrated in FIG. 1C. In the configuration illustrated in FIG. 2A, configuration elements to which the same symbols or reference numerals as illustrated in FIG. 1C are attached have the same configuration as illustrated in FIG. 1C.

The USB processing circuit 100 according to the present embodiment does not need the wire switching circuit 11, and includes a power line which extends from the power supply circuit 21 and branches off to the first connection port 10*a* and the second connection port 10*b*, and a signal line which extends from a signal processing circuit 220 and branches off to the first connection port 10*a* and the second connection port 10*b*.

Furthermore, the signal processing circuit 220 is connected to the first connection port 10*a* by the signal line (may be connected to the second connection port 10*b*), and can detect whether or not a connector is connected to the first connection port 10*a*. According to the aforementioned configuration, output power of the power supply circuit 21 is supplied to the device 30 through a connector or a cable connected to the first connection port 10*a* or the second connection port 10*b*. In addition, the signal processing circuit 220 can communicate with the device 30 through the connector or the cable connected to the first connection port 10*a* or the second connection port 10*b*.

In the aforementioned configuration, the power supply circuit 21 and the signal processing circuit 220 which are common in each standard of the USB Type C and USB Type A may also be included. For this reason, it is possible to simplify a configuration of a circuit of an electronic apparatus.

Furthermore, a first connection port may be a connection port of the USB Type C. Hence, a shape or a terminal of an insertion portion of a connector may be disposed such that a connector of the USB Type C is connected and thereby communication can be performed (power may be able to be received and transmitted).

A second connection port may be a connection port of the USB other than the USB Type C. Hence, a shape or a terminal of an insertion portion of the connector may be disposed such that a connector of a USB standard other than the USB Type C is connected, and thereby, communication can be performed (power may be able to be received and transmitted). For example, the USB Type A or B, the mini-USB Type A, B or AB, micro-USB Type A, B, or AB, or the like can be used as the USB standard other than the USB Type C.

A wire may branch off to a first connection port and a second connection port. That is, a wire which extends from a circuit included in an electronic apparatus to the first connection port and the second connection port is included, and the wire branches off to be connected to the first connection port and the second connection port. In addition, each of the first connection port and the second connection port is connected to a circuit included in an electronic apparatus.

The wire may be used for various purposes, and may be one or both of a signal line and a power line. Branching of the wire may be performed by various circuits, may be performed by simple branching which divides the wire, and may be performed by a wire switching circuit which switches connection of wires by using a switch or the like.

The wire can be formed by a configuration or the like that includes, for example, a communication line connected to a first connection port, a communication line connected to a second connection port, and a wire switching circuit which connects a communication line of an electronic apparatus to any one of the respective communication lines in a switchable manner. In a configuration in which the wires are switched by the wire switching circuit, a state where any one of the first connection port and the second connection port is connected to the communication line of the electronic apparatus and the other is not connector thereto can be realized. For this reasons, it is preferable that a configuration for transmitting a signal whose frequency is high and frequency loss cannot be neglected, for example, a signal according to the SuperSpeed standard be provided.

Of course, the wire switching circuit may include other circuits, for example, a redriver (repeater) circuit which shapes a waveform of a signal, or a connection detecting circuit which detects that a connector is connected to at least one of the first connection port and the second connection port. If the latter is used, it is possible to easily switch wires of signals on the basis of the detected results.

In a case where a connector is connected to one of the first connection port and the second connection port, the exclusive structure may be a structure in which a connector cannot be connected to the other. That is, an electronic apparatus structurally has a configuration in which the USB of the USB Type C and the USB other than the USB Type C cannot be used at the same time. Such a configuration may have a configuration in which various configurations can be employed, and in a case where simultaneous use of the first connection port and the second connection port is attempted, a connector interferes with other connectors or a structure around the connection port and thereby the simultaneous use cannot be done, and one connection port can be selectively used.

For example, in a case where connectors are respectively connected to the first connection port and the second connection port, an exclusive structure may be formed in which each connection port is configured such that the connectors are in a positional relationship of spatially overlapping each other. That is, in a case where, in a state where a connector is connected to one connection port, another connector is connected to the other connection port, a configuration may be performed in which the former connector interfere with the latter connector such that the latter connector cannot be inserted into the connection port.

The exclusive structure can be specified by, for example, analyzing a size of the connector, or the like in advance. That is, a shape or a size of a connector is approximately determined by the USB standard (USB Type C or others). Hence, when shapes or sizes of connectors according to each standard are specified by statistics or the like in advance, each connection port may by formed such that, in a case where a connector is connected to the second connection port, the connector is positioned on an inner side of the periphery of a connector, in a case where the connector is connected to the first connection port.

Such a configuration can be realized by a configuration in which, for example, a long side of each of the first connection port and the second connection port faces a first direction, the first connection port and the second connection port are in the same position in the first direction, and a distance between the center of a short side direction of the first connection port and the center of a short side direction of the second connection port is less than 7.25 mm in a second direction orthogonal to the first direction.

That is, if each connection port is disposed such that connectors interfere with each other in two directions orthogonal to each other, the first connection port and the second connection port can be disposed in a positional relationship in which the connectors spatially overlap each other. Hence, if the first connection port and the second connection port overlap each other at least partially in the first direction, the first connection port and the second connection port can be disposed such that connectors interfere with each other in the first direction.

In addition, if the first connection port and the second connection port are configured such that a distance between the centers of the short side directions thereof in the second direction is less than a specified distance, the first connection port and the second connection port can be disposed such that the connectors also interfere with each other in the second direction by adjusting the specified distance. The specified distance can be adjusted on the basis of a size of the connector, but the distance can be set to be less than, for example, 7.25 mm. That is, a maximum value of a connector of the USB Type C in a short side direction is 6.5 mm and a maximum value of a connector of the USB Type A in a short side direction is 8.0 mm, and thus, it is necessary to set a distance between the centers of the short side directions of the first connection port and the second connection port to be less than 7.25 (=(8.0+6.5)/2) mm so as to make the connectors interfere with each other.

Various values can be employed as values less than 7.25 mm, and, for example, a value at which almost all the connectors statistically interfere with each other may be selected. Here, the first connection port and the second connection port are configured to be in the same position in the first direction that long sides of the first connection port and the second connection port face, but, of course, the first connection port and the second connection port may be configured to be in the same position in a direction that a short side faces, and a configuration may be provided in which a distance between the centers in the long side direction is less than a specified distance in a direction that the long sides face.

Figure 2B:
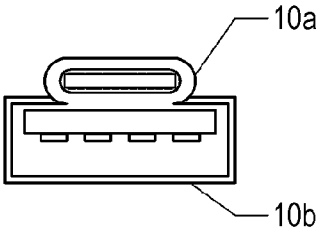
FIG. 2B, FIG. 2C, and FIG. 2D are explanatory views of an exclusive structure.

Furthermore, a hole of the first connection port and a hole of the second connection port may be configured to be connected to each other. FIG. 2B is a diagram illustrating the configuration example. FIG. 2B is a view illustrating a state where the connection port which is formed on an outer surface of an electronic apparatus that functions as a host is viewed. An opening of the first connection port 10*a* and an opening of the second connection port 10*b* which are illustrated in the same figure are connected to each other. The configuration can be realized by simply connecting the connection ports, and thus, the configuration can be realized without performing a layout such as adjusting positions of the first connection port 10*a* and the second connection port 10*b* by considering a size or the like of a connector to be connected to the first connection port 10*a* or the second connection port 10*b*. Hence, in a case where a connector is connected to one of the first connection port and the second connection port, it is possible to easily realize an exclusive structure by which a connector cannot be connected to the other connection port.

In the exclusive structure which is configured such that, in a case where simultaneous use of the first connection port and the second connection port is attempted, a connector interferes with other connectors or a structure around the connection port, and thereby, the simultaneous use cannot be done, and one connection port can be selectively used, for example, a configuration can be employed in which the exclusive structure can be formed by a shutter that selectively blocks one of the first connection port and second connection port. That is, in a case where one of the first connection port and the second connection port is blocked by a shutter, a configuration may be provided in which the other connection port can be connected to a connector without being blocked by the shutter.

Figure 2C:
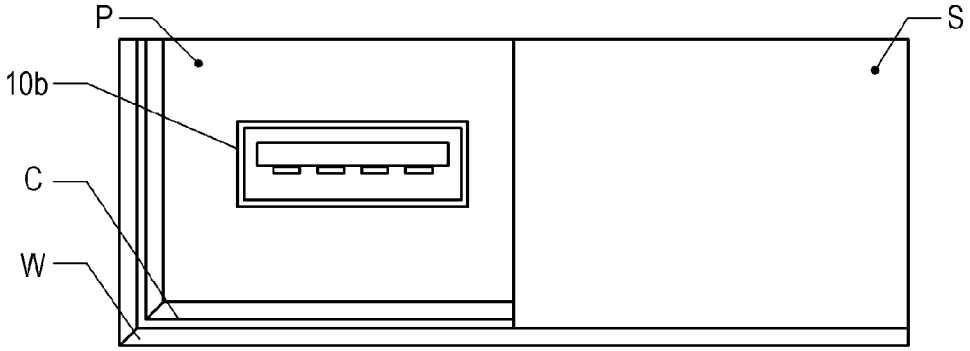
Figure 2D:
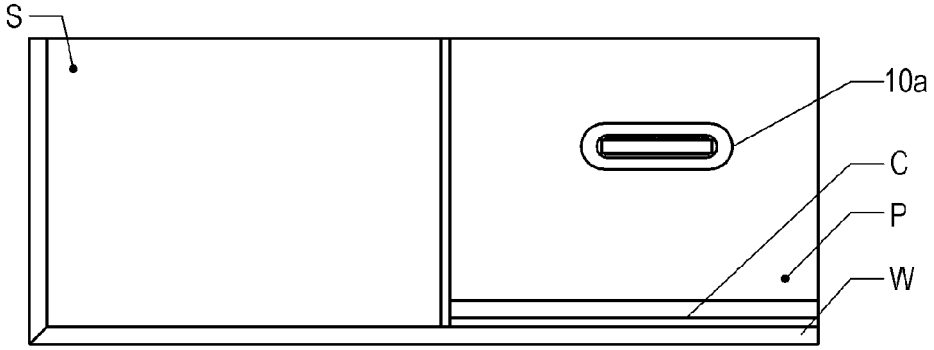

FIGS. 2C and 2D are views illustrating the configuration example. Each of the figures illustrates a state where a connection port which is formed on an outer surface of an electronic apparatus that functions as a host is viewed. In the example illustrated in the figures, a recess portion P is formed on an outer surface of the electronic apparatus, and the first connection port 10*a* and the second connection port 10*b* are formed on an inner wall of the recess portion P. In the present embodiment, the first connection port 10*a* and the second connection port 10*b* are formed at a position of ¼ of a length from one end of the recess portion P in a long side direction and at a position of ¾ of a length from the one end.

In addition, a groove C having a predetermined depth in a direction perpendicular to a side wall W is formed on the side wall W of the recess portion P. A shutter S with a thickness slightly smaller than a width of the groove C is fitted on the groove C. The shutter S has a length of approximately half the length of the recess portion P in a long side direction. Hence, by sliding the shutter S in the long side direction, one of the first connection port 10*a* and the second connection port 10*b* can be blocked, and the other connection port is not blocked. According to the configuration, it is possible to simply form a configuration in which a configuration in which, in a case where a connector is connected to one connection port, another connector cannot be connected to the other connection port.

The shutter may be able to block or open each connection port, and a configuration may be provided in which, in a case where a connector is connected to the block connection port to be used, at least the shutter and the connector interfere with each other, and thereby, another connector cannot be connected to the connection port. The shutter may be able to move forward or backward to block or open the connection port, and various shutters such as a rotary type shutter can be employed in addition to the slide type shutter illustrated in FIGS. 2C and 2D.

In addition, connection detection of the second connection port 10*b* may not be performed. Specifically, in a case where an output signal of the connection detecting circuit 11*a* indicates that a connector is connected to the first connection port 10*a*, the BUS switching circuit 11*b* controls the switch such that the first connection port 10*a* is connected to the signal processing circuit 22. In addition, in a case where the output signal of the connection detecting circuit 11*a* indicates that the connector is not connected to the first connection port 10*a*, the BUS switching circuit 11*b* controls the switch such that the second connection port 10*b* is connected to the signal processing circuit 22.

Furthermore, as described above, a technology in which, if a connector is connected to one of connection ports of the USB according to different standards, another connector cannot be connected to the other connection port, can also be realized as a method.

What is claimed is:

1. An electronic apparatus comprising:

a first connection port that is a connection port of a USB Type C;

a second connection port that is a connection port of a USB other than the USB Type C;

an exclusive structure that includes a shared portion between the first connection port and the second connection port, wherein the shared portion prevents two types of connectors from being connected at the same time; and circuitry that includes a communication line that is associated with both the first connection port and the second connection port, wherein the circuitry connects the communication line to whichever one of the first connection port and the second connection port is connected to a connector.

2. The electronic apparatus according to claim 1, wherein a long side of each of the first connection port and the second connection port faces a first direction, the first connection port and the second connection port are in the same position in the first direction, and a distance between a center of a short side direction of the first connection port and a center of a short side direction of the second connection port is less than 7.25 mm in a second direction orthogonal to the first direction.

3. The electronic apparatus according to claim 1, wherein a hole of the first connection port is connected to a hole of the second connection port, wherein the hole of the first connection port is sized to receive a first connector and wherein the hole of the second connection port is sized to receive a second connector.

4. An electronic apparatus comprising:

a first connection port that is a connection port of a USB Type C;

a second connection port that is a connection port of a USB other than the USB Type C;

a first communication line that is connected to the first connection port and a second communication line that is connected to the second connection port;

a communication line of the electronic apparatus, wherein the communication line is configured to operate with both the first connection port and with the second connection port; and a switch that connects the communication line of the electronic apparatus to any one of the respective first and second communication lines in a switchable manner, wherein the electronic apparatus has an exclusive structure in which a portion of the exclusive structure is shared by both the first connection port and the second connection port such that, in a case where a connector is connected to one of the first connection port and the second connection port, another connector is not able to be connected to the other of the first and second connection ports.

5. The electronic apparatus according to claim 4, further comprising:

a connection detecting circuit that detects whether or not a connector is connected to the first connection port, wherein the switch switches a connection between a communication line that is connected to a connection port to which a connector is connected and a communication line of the electronic apparatus.

6. The electronic apparatus according to claim 4, wherein a long side of each of the first connection port and the second connection port faces a first direction, the first connection port and the second connection port are in the same position in the first direction, and a distance between a center of a short side direction of the first connection port and a center of a short side direction of the second connection port is less than 7.25 mm in a second direction orthogonal to the first direction.

7. The electronic apparatus according to claim 4, wherein a hole of the first connection port is connected to a hole of the second connection port, wherein the hole of the first connection port is sized to receive a first connector and wherein the hole of the second connection port is sized to receive a second connector.

* * * * *